US009156294B2

(12) United States Patent
Kitawaki et al.

(10) Patent No.: US 9,156,294 B2
(45) Date of Patent: Oct. 13, 2015

(54) IMAGE RECORDING APPARATUS AND BASE MATERIAL SUPPLY APPARATUS

(71) Applicant: SCREEN HOLDINGS CO., LTD., Kyoto-shi, Kyoto (JP)

(72) Inventors: Shiro Kitawaki, Kyoto (JP); Toshio Tamura, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 14/496,864

(22) Filed: Sep. 25, 2014

(65) Prior Publication Data

US 2015/0091999 A1 Apr. 2, 2015

(30) Foreign Application Priority Data

Sep. 27, 2013 (JP) ..... 2013-201464

(51) Int. Cl.

| | |
|---|---|
| ***B41J 15/16*** | (2006.01) |
| ***B41J 15/04*** | (2006.01) |
| ***B41M 5/00*** | (2006.01) |
| ***B41J 11/00*** | (2006.01) |
| ***B65H 19/18*** | (2006.01) |

(52) U.S. Cl.

CPC ..... *B41J 15/16* (2013.01); *B41J 11/0015* (2013.01); *B41J 15/04* (2013.01); *B41M 5/0011* (2013.01); *B65H 19/1852* (2013.01); *B65H 2301/31* (2013.01); *B65H 2301/4492* (2013.01); *B65H 2301/4493* (2013.01); *B65H 2301/4622* (2013.01); *B65H 2301/4631* (2013.01); *B65H 2301/513* (2013.01); *B65H 2801/03* (2013.01)

(58) Field of Classification Search

USPC ..... 347/104

See application file for complete search history.

(56) References Cited

U.S. PATENT DOCUMENTS

| | | | | |
|---|---|---|---|---|
| 4,878,986 | A | 11/1989 | Nishikawa | |
| 6,528,129 | B1 * | 3/2003 | Kondo | 427/536 |
| 2006/0035033 | A1 | 2/2006 | Tanahashi et al. | |
| 2013/0250017 | A1 | 9/2013 | Saitoh et al. | |

FOREIGN PATENT DOCUMENTS

| | | | |
|---|---|---|---|
| DE | 2617877 | A1 | 11/1977 |
| DE | 19912054 | A1 | 9/2000 |
| EP | 2783872 | A1 | 10/2014 |
| JP | 2001-131314 | A | 5/2001 |
| JP | 2012-081608 | A | 4/2012 |

OTHER PUBLICATIONS

European Search Report EP 14 18 4391.2-1701 dated Jan. 28, 2015.

* cited by examiner

*Primary Examiner* — Stephen Meier
*Assistant Examiner* — Alexander D Shenderov
(74) *Attorney, Agent, or Firm* — McDermott Will & Emery LLP

(57) ABSTRACT

An image recording apparatus includes an unwinder, a recorder, a take-up part, a first supporter, a surface modifying part, and a second supporter. The unwinder unwinds a base material from a roll. The recorder records an image onto a surface of the base material. The take-up part takes up the base material on which an image has been recorded by the recorder. The first supporter supports the base material that is being conveyed in a direction away from the recorder after having been unwound from the unwinder. The surface modifying part modifies a surface of the base material by energizing the surface of the base material that has passed through the first supporter. The second supporter supports the base material that is being conveyed in a direction toward the recorder after having passed through the surface modifying part. The second supporter is more distant from the unwinder than the first supporter is. The unwinder is disposed on at least one of a virtual line segment that connects the surface modifying part and the recorder and a normal to the line segment.

11 Claims, 5 Drawing Sheets

IMAGE RECORDING APPARATUS AND BASE MATERIAL SUPPLY APPARATUS

CROSS-REFERENCE TO RELATED APPLICATIONS

This Application claims priority to Japanese Patent Application No. 2013-201464 dated Sep. 27, 2013, the subject matter of which is incorporated by reference herein in entirety.

BACKGROUND OF THE INVENTION

1. Field of the Invention

The present invention relates to an image recording apparatus for recording an image onto a surface of a sheet-like base material, and a base material supply apparatus for supplying a base material to a recorder that records an image onto a surface of a sheet-like base material.

2. Description of the Background Art

Image recording apparatuses are known, which unwind a sheet-like base material from a cylindrical roll and write an image on a surface of the base material by inkjet printing or the like.

With these image recording apparatuses, the quality (image quality) of an image to be written on the surface of the base material will improve if, for example, ink landing on the base material is easy to spread over the surface of the base material during inkjet printing. Thus, there are cases where pre-processing for improving ink wettability is performed on the base material before printing. One example of a technique for performing pre-processing is a technique using a corona discharge treatment apparatus to impart required wettability to a sheet (see Japanese Patent Application Laid-open Nos. 2001-131314 and 2012-81608, for example). There is also a constant demand for compact image recording apparatuses from the viewpoint of securing installation locations.

However, with the techniques disclosed in Japanese Patent Application Laid-open Nos. 2001-131314 and 2012-81608 in which the corona discharge treatment apparatus uses a relatively high voltage for discharge, if the corona discharge treatment apparatus is disposed in the vicinity of a recorder for recording an image or the like, noise caused by the discharge may be superimposed on various types of signals, causing various problems such as disturbances in images to be printed. Such a problem arises not only from apparatuses that perform pre-processing on a base material by a corona discharge, but are also common to apparatuses in general that perform other pre-processing such as the application of plasma to a base material to modify the surface of the base material at a relatively high voltage.

SUMMARY OF THE INVENTION

The present invention is directed to an image recording apparatus.

According to the present invention, the image recording apparatus includes an unwinder that unwinds a sheet-like base material from a roll around which the base material is cylindrically wound, a recorder that records an image onto a surface of the base material, a take-up part that takes up the base material on which an image has been recorded by the recorder, a first supporter that supports the base material that is being conveyed in a first direction away from the recorder after having been unwound from the unwinder, a surface modifying part that modifies the surface of the base material by energizing the surface of the base material that has passed through the first supporter, and a second supporter that supports the base material that is being conveyed in a second direction toward the recorder after having passed through the surface modifying part. The second supporter is more distant from the unwinder than the first supporter is. The unwinder is disposed on at least one of a virtual line segment that connects the surface modifying part and the recorder and a normal to the line segment.

Since the distance between the surface modifying part and the recorder can be increased without increasing the size of the apparatus, it is possible to achieve a compact image recording apparatus capable of reducing adverse effects of noise caused by pre-processing for modifying the surface of the base material.

Preferably, the first supporter includes at least one roller that is rotatably provided to support the base material.

It is thus possible to readily convey and support the base material.

Preferably, the first supporter includes a table part that supports the base material.

It is thus possible to perform various types of processing such as cutting on the base material before being subjected to surface modification on the table part.

Preferably, the table part has an opening in a base material supporting surface that supports the base material, and has a groove-like knife-edge bearing area that extends in a direction that intersects the first direction.

It is thus possible to precisely cut the base material along the knife-edge bearing area on the table part.

Preferably, the first supporter includes a movable part provided facing a base material supporting surface of the table part that supports the base material, and a driving part that moves the movable part between a catch position and a spaced position, the catch position being a position at which the movable part catches hold of the base material supported by the table part in between the movable part and the table part, and the spaced position being a position at which the movable part is spaced from the base material supported by the table part.

It is thus possible to readily and precisely perform various types of processing such as cutting on the base material because the base material can be fixed to the table part during the processing.

Preferably, the first supporter further includes a movable part provided facing the base material supporting surface, and a driving part that moves the movable part between a catch position and a spaced position, the catch position being a position at which the movable part catches hold of the base material supported by the table part in between the movable part and the table part, and the spaced position being a position at which the movable part is spaced from the base material supported by the table part.

It is thus possible to readily and precisely perform various types of processing such as cutting on the base material because the base material can be fixed to the table part during the processing.

Preferably, the movable part includes a first abutment part that catches hold of the base material between the first abutment part and a first area of the base material supporting surface, the first area being located on a side opposite the first direction from the knife-edge bearing area, and a second abutment part that catches hold of the base material between the second abutment part and a second area of the base material supporting surface, the second area being located on a side toward the first direction from the knife-edge bearing area.

It is thus possible to more precisely cut the base material on the table part because the base material can be fixed to both upstream and downstream sides of the knife-edge bearing area during the cutting process.

Preferably, the driving part individually moves the first abutment part and the second abutment part between the catch position and the spaced position.

It is thus possible to precisely couple the base materials to each other on the table part when the roll is exchanged.

Preferably, the surface modifying part includes a corona discharge part that energizes a surface of the base material by a corona discharge to modify the surface of the base material.

It is thus possible to readily modify the surface of the base material.

Preferably, the surface modifying part includes a plasma application part that energizes a surface of the base material by application of plasma to modify the surface of the base material.

It is thus possible to readily modify the surface of the base material.

The present invention is also directed to a base material supply apparatus for supplying a sheet-like base material to a recorder that records an image onto a surface of the base material.

According to the present invention, the base material supply apparatus includes an unwinder that unwinds the base material from a roll around which the base material is cylindrically wound, a base material supply part that supplies the base material to the recorder, a first supporter that supports the base material that is being conveyed in a first direction away from the base material supply part after having been unwound from the unwinder, a surface modifying part that modifies a surface of the base material by energizing the surface of the base material that has passed through the first supporter, and a second supporter that supports the base material that is being conveyed in a second direction toward the base material supply part after having passed through the surface modifying part. The second supporter is more distant from the unwinder than the first supporter is. The unwinder is disposed on at least one of a virtual line segment that connects the surface modifying part and the base material supply part and a normal to the line segment.

Since the distance between the surface modifying part and the recorder can be increased without increasing the size of the apparatus, it is possible to achieve a compact image recording apparatus capable of reducing adverse effects of noise caused by pre-processing for modifying the surface of the base material.

It is an object of the present invention to provide a technique for achieving a compact image recording apparatus capable of reducing adverse effects of noise caused by pre-processing for modifying the surface of a base material.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
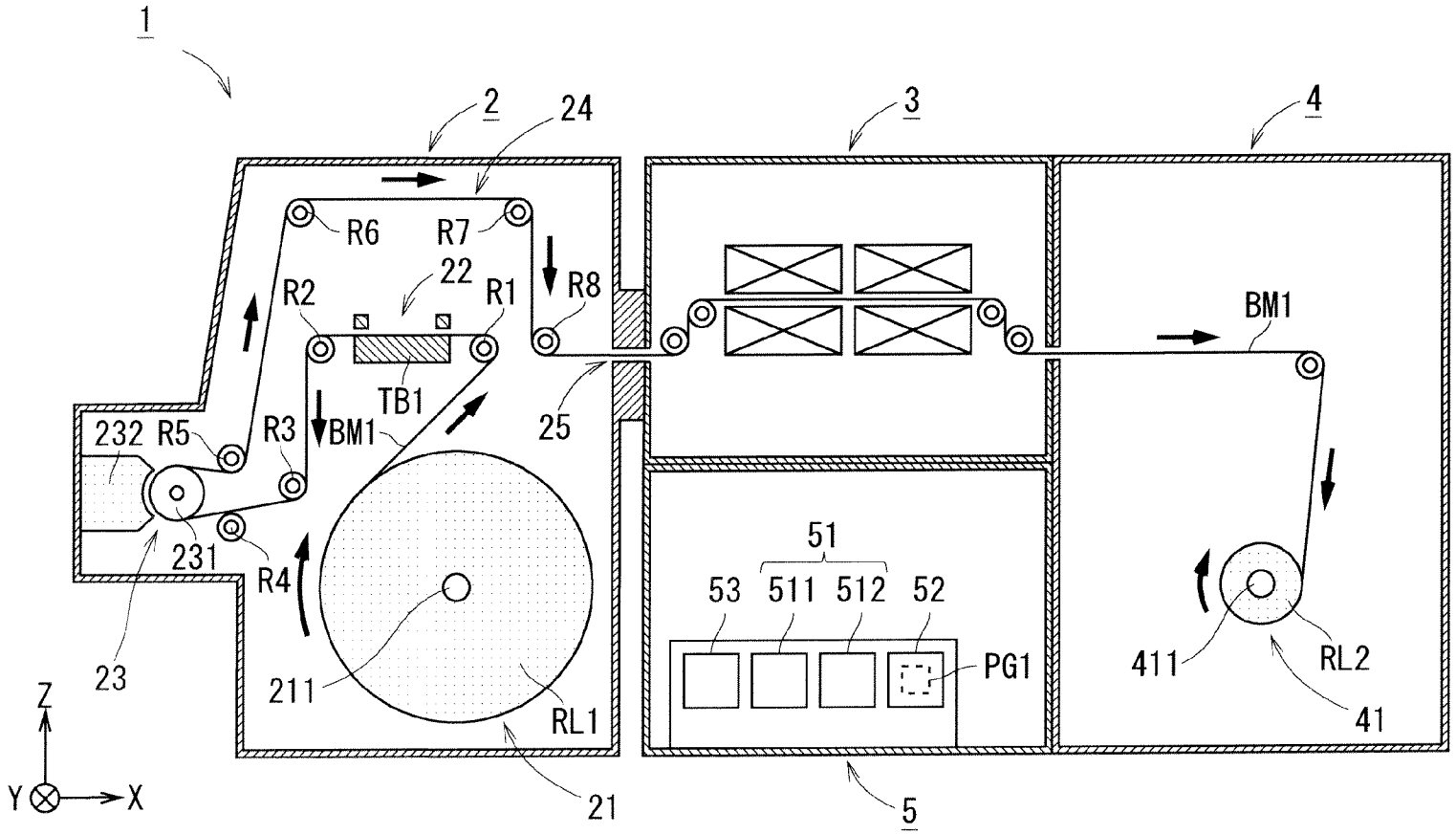
FIG. 1 illustrates a schematic configuration of an image recording apparatus according to a preferred embodiment.

A preferred embodiment of the invention will now be described below with reference to the accompanying drawings. In the drawings, constituent elements that have the same configurations and functions shall be given the same reference numerals, and redundant descriptions thereof shall be omitted. The drawings are all merely illustrative examples, and the sizes and relative positions of various constituent elements in the drawings may be appropriately changed, for example. Note that FIGS. 1 to 12 show a right-handed XYZ coordinate system in which +X direction is a direction (right direction in FIG. 1) in which a base material BM1 is conveyed from a base material supply unit 2 to a base material collecting unit 4. In FIGS. 1 and 12, the directions of rotation of rolls RL1 and RL2 and the conveyance direction of the base material BM1 are indicated by bold arrows.

(1) Overview of Image Recording Apparatus

FIG. 1 illustrates a schematic configuration of an image recording apparatus 1 according to a preferred embodiment. As shown in FIG. 1, the image recording apparatus 1 includes the base material supply unit 2, a recorder 3, and the base material collecting unit 4. The image recording apparatus 1 further includes a control unit 5.

The base material supply unit 2 is a unit that supplies the sheet-like base material BM1 to the recorder 3. The base material supply unit 2 supplies the base material BM1 that has been unwound from the roll RL1 by an unwinder 21, to the recorder 3. At this time, a surface modifying part 23 performs processing for modifying the surface of the base material BM1 in accordance with the properties of the base material BM1. Examples of the base material BM1 include sheet-like materials such as paper and polyethylene terephthalate (PET) films.

The recorder 3 is a unit that records an image onto a surface of the base material BM1. The recorder 3 records an image by, for example, writing the image onto the surface of the base material BM1. For example, inkjet printing or other printing methods are employed as the method for writing an image on the surface of the base material BM1.

The base material collecting unit 4 is a unit that collects the base material BM1 by a take-up part 41 taking up the base material BM1 on which an image has been recorded by the recorder 3. In the take-up part 41, a rotational shaft 411 that is rotatably provided in, for example, a casing (not shown) of the image recording apparatus 1 is rotated so that the base material BM1 is taken up on the outer circumference of the rotational shaft 411, forming a roll RL2 on and around the circumference of the rotational shaft 411.

The control unit 5 is a unit that controls operations performed by the image recording apparatus 1. The control unit 5 includes a controller 51, a storage 52, and an operating part 53. The controller 51 includes a processor 511 and a memory 512, for example, and achieves various types of control by executing a program PG1 stored in the storage 52. The storage 52 may, for example, be a hard disk or a nonvolatile memory such as a ROM. The operating part 53 includes buttons or the like that receive input of various types of operations from a user, for example.

(2) Base Material Supply Apparatus

The base material supply unit 2 serving as a base material supply apparatus includes the unwinder 21, a first supporter 22, the surface modifying part 23, a second supporter 24, and a base material supply part 25. The base material supply unit 2 also includes rollers R1 to R8 that are rotatably provided in, for example, the casing (not shown) of the image recording apparatus 1.

The unwinder 21 is a part that unwinds the sheet-like base material BM1 from the roll RL1 around which the base material BM1 is cylindrically wound. The unwinder 21 includes a rotational shaft 211. The rotational shaft 211 is rotatably provided in, for example, the casing (not shown) of the image recording apparatus 1. The roll RL1 is mounted on the outer circumference of the rotational shaft 211. When the roll RL1 is mounted on the rotational shaft 211, the rotational shaft 211 is inserted into a through hole formed in the core of the roll RL1, for example. Then, for example, the take-up part 41 takes up the base material BM1 that is unwound from the outer circumference of the roll RL1, with the result that the roll RL1 is rotated together with the rotational shaft 211 about a virtual axis extending in the Y direction. Consequently, the base material BM1 is unwound from the outer circumference of the roll RL1, and the sheet of base material BM1 is stripped from the outer circumference of the roll RL1.

The first supporter 22 supports the base material BM1 that is unwound from the unwinder 21 and is being conveyed in a direction (first direction) away from the base material supply part 25 provided on the recorder 3 side. In other words, the first supporter 22 supports the base material BM1 that is being conveyed in the first direction away from the recorder 3. The first supporter 22 of the present preferred embodiment supports the base material BM1 with the rollers R1 and R2. In this way, since the first supporter 22 uses the rollers R1 and R2 to support the base material BM1, it is easy to convey and support the base material BM1. In the present preferred embodiment, the base material BM1 that has passed through the first supporter 22 further passes through the roller R3 and is conveyed to the surface modifying part 23.

The surface modifying part 23 is a part that modifies a surface of the base material BM1 by energizing the surface of the base material BM1 that has passed through the first supporter 22. The surface modifying part 23 includes the rollers R4 and R5, a support roller 231, and an energizing part 232, for example. In the present preferred embodiment, the base material BM1 is conveyed passing through the roller R4, the support roller 231, and the roller R5 in order. At this time, the energizing part 232 energizes the base material BM1 that is supported by the support roller 231.

Here, the energizing part 232 may, for example, be a part (corona discharge part) that energizes the surface of the base material BM1 by the application of ions produced by a corona discharge to modify the surface of the base material BM1. Alternatively, the energizing part 232 may, for example, be a part (plasma application part) that energizes the surface of the base material BM1 by the application of plasma to modify the surface of the base material BM1. Such energization processing (pre-processing) will improve ink wettability of the surface of the base material BM1 before an image is recorded on the base material BM1. It is thus possible to readily modify the surface of the base material BM1.

The second supporter 24 supports the base material BM1 that has passed through the surface modifying part 23 and is being conveyed in a direction (second direction) toward the base material supply part 25 provided on the side of the recorder 3. In other words, the second supporter 24 supports the base material BM1 that is being conveyed in the second direction toward the recorder 3. The second supporter 24 is more distant from the unwinder 21 than the first supporter 22 is. In the present preferred embodiment, the second supporter 24 is provided upward of the unwinder 21 at a position that is spaced more upwardly from the unwinder 21 than the first supporter 22 is. The second supporter 24 of the present preferred embodiment supports the base material BM1 with the rollers R6 and R7. It is thus easy to convey and support the base material BM1. In the present preferred embodiment, the base material BM1 that has passed through the second supporter 24 further passes through the roller R8 and is conveyed to the base material supply part 25.

The base material supply part 25 is a part that supplies the base material BM1 to the recorder 3. The base material supply part 25 is provided with an opening that the base material BM1 can pass through, for example. The opening may, for example, be a slit-like opening having a shape that conforms to the cross-sectional shape of the base material BM1. In the base material supply part 25, a non-contact or contact web cleaner that removes dust and dirt adhering to the surface of the base material BM1 is disposed as necessary, for example. In the present preferred embodiment, the base material supply part 25 couples the base material supply unit 2 and the recorder 3.

In the base material supply unit 2 having the above-described configuration, the unwinder 21 is disposed on the normal to a virtual line segment that connects the surface modifying part 23 and the base material supply part 25. In other words, the unwinder 21 is disposed on the normal to a virtual line segment that connects the surface modifying part 23 and the recorder 3. In the present preferred embodiment, the surface modifying part 23 is disposed at a position that is more distant from the base material supply part 25 and the recorder 3 than the unwinder 21 is. With this configuration, the unwinder 21 can be disposed with no waste space even if the distance between surface modifying part 23 and the recorder 3 is increased. It is thus possible to increase the distance between the surface modifying part 23 and the recorder 3 without increasing the sizes of the image recording apparatus 1 and the base material supply unit 2. This consequently reduces adverse effects of noise caused by the surface modifying part 23 performing pre-processing for modifying the surface of the base material BM1.

Note that similar effects can also be achieved even if the unwinder 21 is disposed on the virtual line segment connecting the surface modifying part 23 and the base material supply part 25 or the virtual line segment connecting the surface modifying part 23 and the recorder 3. In other words, the unwinder 21 may be disposed in a space sandwiched between the surface modifying part 23 and the base material supply part 25 or a space sandwiched between the surface modifying part 23 and the recorder 3. Accordingly, it is sufficient for the unwinder 21 to be disposed on at least one of the virtual line segment that connects the surface modifying part 23 and the recorder 3 and the normal to the line segment. For example, a configuration may be employed in which the surface modifying part 23 is more distant from the base material supply part 25 and the recorder 3 than the first and second supporters 22 and 24 are.

(3) First Supporter

Figure 2:
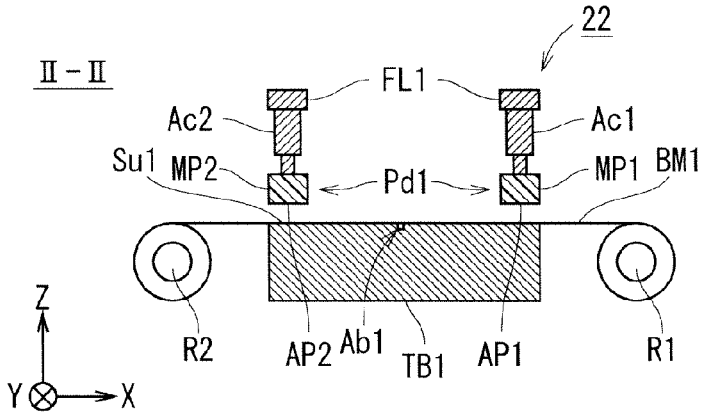
FIGS. 2 and 3 are cross-sectional views schematically illustrating an exemplary configuration of a first supporter.
Figure 3:
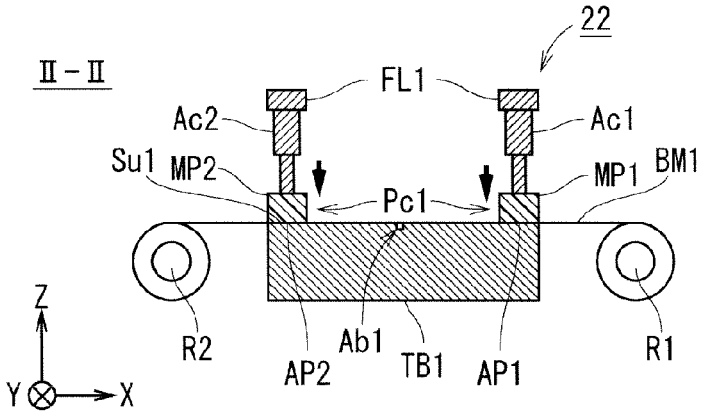
Figure 4:
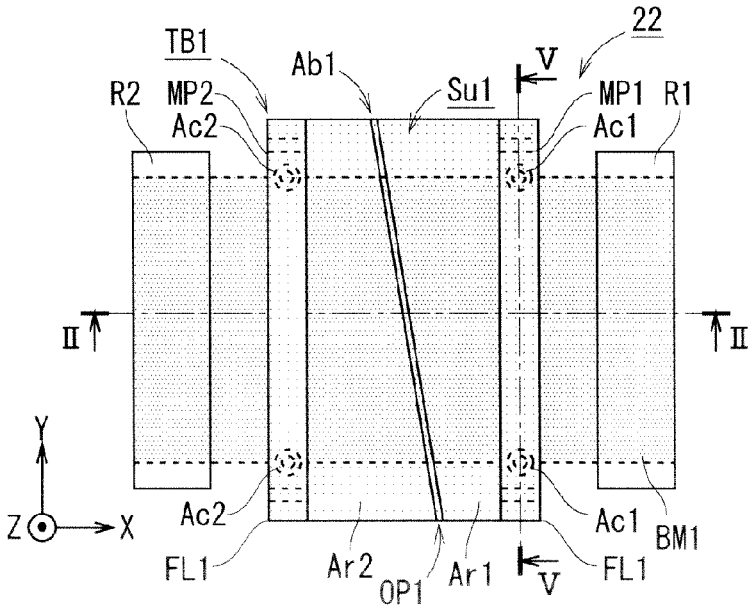
FIG. 4 is a plan view schematically illustrating the exemplary configuration of the first supporter.
Figure 5:
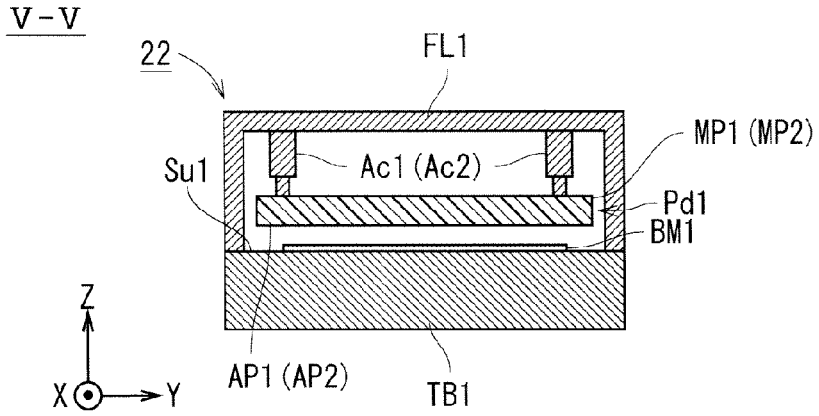
FIGS. 5 and 6 are cross-sectional views schematically illustrating the exemplary configuration of the first supporter.
Figure 6:
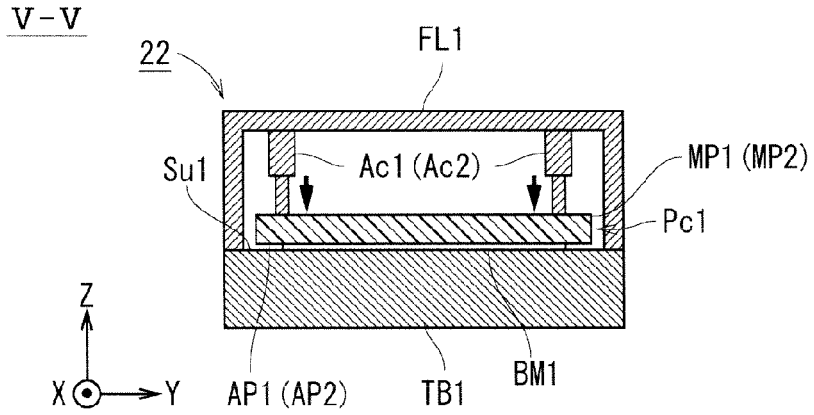

FIGS. 2 and 3 are cross-sectional views schematically illustrating an exemplary configuration of the first supporter 22. FIG. 4 is a plan view schematically illustrating the exemplary configuration of the first supporter 22. FIGS. 5 and 6 are cross-sectional views schematically illustrating the exemplary configuration of the first supporter 22. Note that FIGS. 2 and 3 illustrate a cross section taken along the dashed dotted line II-II in FIG. 4. In FIG. 4, the outer edge of the base material BM1 is shown by the broken line. FIGS. 5 and 6 illustrate a cross section taken along the dashed dotted line V-V in FIG. 4. As illustrated in FIGS. 2 to 6, the first supporter 22 includes a table part TB1, movable parts MP1 and MP2, and driving parts Ac1 and Ac2. The first supporter 22 further includes a stationary part FL1.

The table part TB1 supports the base material BM1. The presence of the table part TB1 allows various types of processing such as cutting to be performed on the base material BM1 before being subjected to surface modification on the table part TB1. In the present preferred embodiment, the upper surface of the table part TB1 on the +Z side serves as a surface (base material supporting surface) Su1 that supports a base material BM1. Specifically, the base material BM1 that is hung between the rollers R1 and R2 is supported from the underside by the base material supporting surface Su1 of the table part TB1.

The table part TB1 includes a groove-like knife-edge bearing area Ab1 having an opening OP1 in the base material supporting surface Su1. The knife-edge bearing area Ab1 extends in a direction that intersects the first direction extending along the conveyance direction of the base material BM1. The presence of the knife-edge bearing area Ab1 allows a cutting part of a cutting jig to slide along the knife-edge bearing area Ab1, for example, thus making it possible to precisely cut the base material BM1 on the table part TB1. One example of the cutting jig is a cutting knife. Here, if the knife-edge bearing area Ab1 has the shape of a linear groove, it is easy to cut the base material BM1. The knife-edge bearing area Ab1 as described above can be formed by, for example, disposing two stainless-steel plates to form a slit-like gap.

The movable parts MP1 and MP2 are provided facing the base material supporting surface Su1. The movable parts MP1 and MP2 can catch hold of the base material BM1 between themselves and the table part TB1. In the present example, the base material BM1 will stably be caught by the table part TB1 and the movable parts MP1 and MP2 if the movable parts MP1 and MP2 each have a width greater than that of the base material BM1 in the +Y direction.

The driving parts Ac1 and Ac2 move the movable parts MP1 and MP2 between a position (spaced position) Pd1 that is spaced from the base material BM1 supported by the table part TB1 and a position (catch position) Pc1 at which the movable parts MP1 and MP2 catch hold of the base material BM1 supported by the table part TB1 in between themselves and the table part TB1. FIGS. 2 and 5 illustrate a state in which the movable parts MP1 and MP2 are located at the spaced position Pd1, and FIGS. 3 and 6 illustrate a state in which the movable parts MP1 and MP2 are located at the catch position Pc1. Note that in FIGS. 3 and 6, the direction of movement of the movable parts MP1 and MP2 are indicated by bold arrows. The presence of the movable parts MP1 and MP2 and the driving parts Ac1 and Ac2 allows various type of processing such as cutting to be performed on the base material BM1 before being subjected to surface modification in a state in which the base material BM1 is fixed to the table part TB1, for example. It is thus possible to readily and precisely perform various types of processing on the base material BM1 on the table part TB1.

In the present preferred embodiment, the driving parts Ac1 and Ac2 move the movable parts MP1 and MP2 up and down. The driving parts Ac1 and Ac2 may, for example, be air cylinders that reciprocally move rods that are coupled to the movable parts MP1 and MP2, up and down. The driving parts Ac1 and Ac2 may be attached to the stationary part FL1 that is coupled to the table part TB1, for example. Note that the driving part Ac1 moves the movable part MP1 up and down, and the driving part Ac2 moves the movable part MP2 up and down.

The base material supporting surface Su1 includes an area (first area) Ar1 that is located on the side opposite the first direction from the knife-edge bearing area Ab1, and an area (second area) Ar2 that is located on the side toward the first direction from the knife-edge bearing area Ab1. In the present preferred embodiment, the first direction is the −X direction, and the second direction is the +X direction. The movable part MP1 includes a first abutment part AP1 that catches hold of the base material BM1 in between itself and the first area Ar1, and the movable part MP2 includes a second abutment part AP2 that catches hold of the base material BM1 in between itself and the second area Ar2. With this configuration, the base material BM1 is fixed to the table part TB1 on both upstream and downstream sides of the knife-edge bearing area Ab1 in the conveyance direction of the base material BM1. As a result, it is possible to more precisely cut the base material BM1 on the table part TB1, for example. Note that the base material BM1 can more reliably be fixed to the table part TB1 if the abutment parts AP1 and AP2 are made of a material such as rubber that exerts a great frictional force during conveyance of the base material BM1. In addition, the surface of the base material BM1 will be less susceptible to damage if the abutment parts AP1 and AP2 are made of a material such as rubber that has an elastic force.

In the present preferred embodiment, the driving parts Ac1 and Ac2 individually move the first and second abutment parts AP1 and AP2 between the catch position Pc1 and the spaced position Pd1. Accordingly, it is possible to, when the base material BM1 is cut on the table part TB1, remove one side of the cut end of the base material BM1 from the table part TB1 while keeping the other side of the cut end of the base material BM1 fixed to the table part TB1. For example, when the roll RL1 is exchanged, the base material BM1 that has been targeted for image recording before the roll RL1 is exchanged can be precisely coupled to a new base material BM1 on the table part TB1.

Now, a specific example of operations performed by the first supporter 22 when the roll RL1 is exchanged will be described. FIGS. 7 to 11 are diagrams for explaining the operations of the first supporter 22 performed when the roll RL1 is exchanged.

Figure 7:
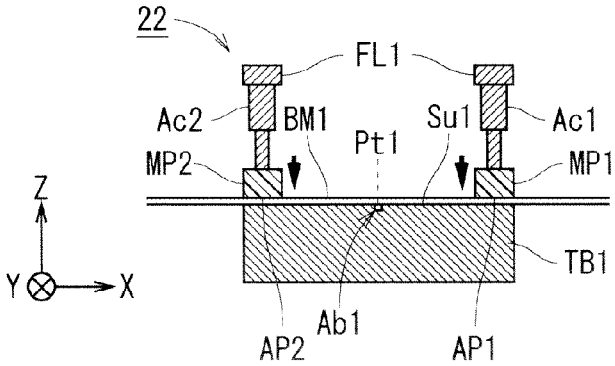
FIGS. 7 to 11 are diagrams for explaining operations of the first supporter performed when a roll is exchanged.

First, as illustrated in FIG. 7, the driving parts Ac1 and Ac2 respectively move the movable parts MP1 and MP2 from the spaced position Pd1 to the catch position Pc1. At this time, the base material BM1 is caught by the first abutment part AP1 and the base material supporting surface Su1 and by the second abutment part AP2 and the base material supporting surface Su1. In this state, the base material BM1 is cut along the knife-edge bearing area Ab1 by sliding the cutting jig along the knife-edge bearing area Ab1.

Figure 8:
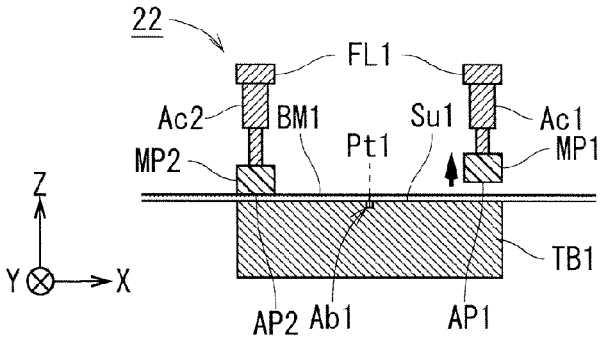

Next, as illustrated in FIG. 8, the driving part Ac1 moves the movable part MP1 from the catch position Pc1 to the spaced position Pd1. In FIGS. 7 and 8, a position (cut position) Pt1 at which the base material BM1 is cut is indicated by the broken line.

Figure 9:
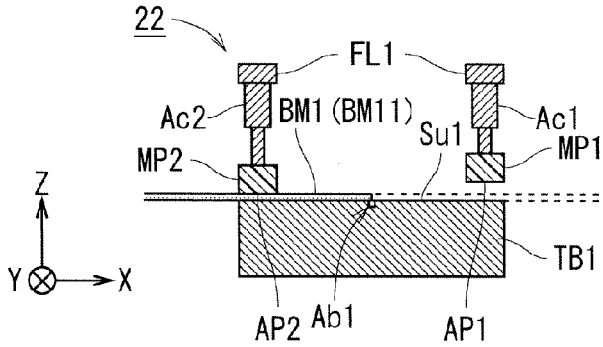

Then, as illustrated in FIG. 9, a portion of the base material BM1 that is located closer to the unwinder 21 and on the upstream side (in the present example, +X side) of the cut position Pt1 is removed from the table part TB1, and the roll RL1 mounted on the unwinder 21 is exchanged for a new roll RL1. Here, the base material BM1 that is drawn from the roll RL1, which has not yet been exchanged, and supported by the table part TB1 is referred to as a "base material BM11," and the base material BM1 that is drawn from the new exchanged roll RL1 is referred to as a "base material BM12." At this time, the front end of the base material BM12 is drawn from the new roll RL1 above the knife-edge bearing area Ab1.

Figure 10:
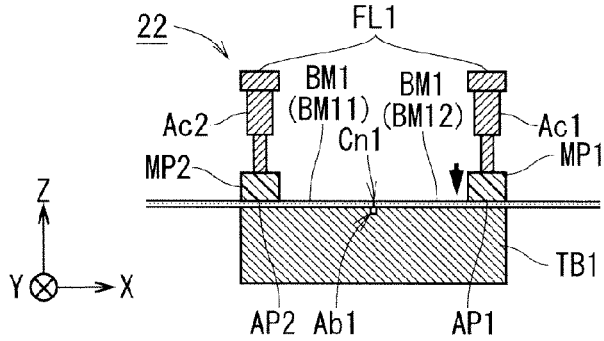

Then, as illustrated in FIG. 10, the driving part Ac1 moves the movable part MP1 from the spaced position Pd1 to the catch position Pc1. Accordingly, the base material BM12 is caught by the first abutment part AP1 and the base material supporting surface Su1. At this time, if, for example, the front end of the base material BM12 is superimposed on the rear end of the base material BM11 and the cutting jig is moved to slide along the knife-edge bearing area Ab1, the front end of the base material BM12 is cut such that the rear end of the base material BM11 and the front end of the base material BM12 abut on their respective end faces. This provides a connection Cn1 at which the rear end of the base material BM11 is coupled to the front end of the base material BM12. The connection Cn1 is formed by, for example, applying adhesive tape to a position at which the adhesive tape is superimposed on both of the rear end of the base material BM11 and the front end of the base material BM12.

Figure 11:
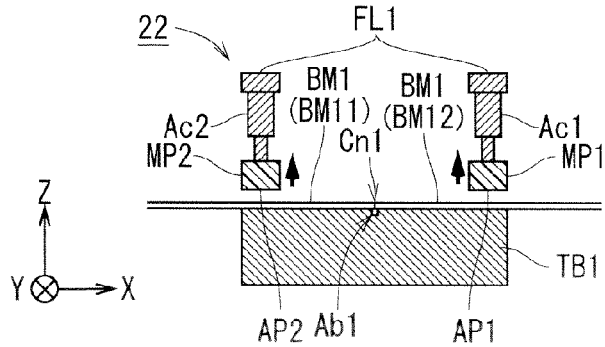
Figure 12:
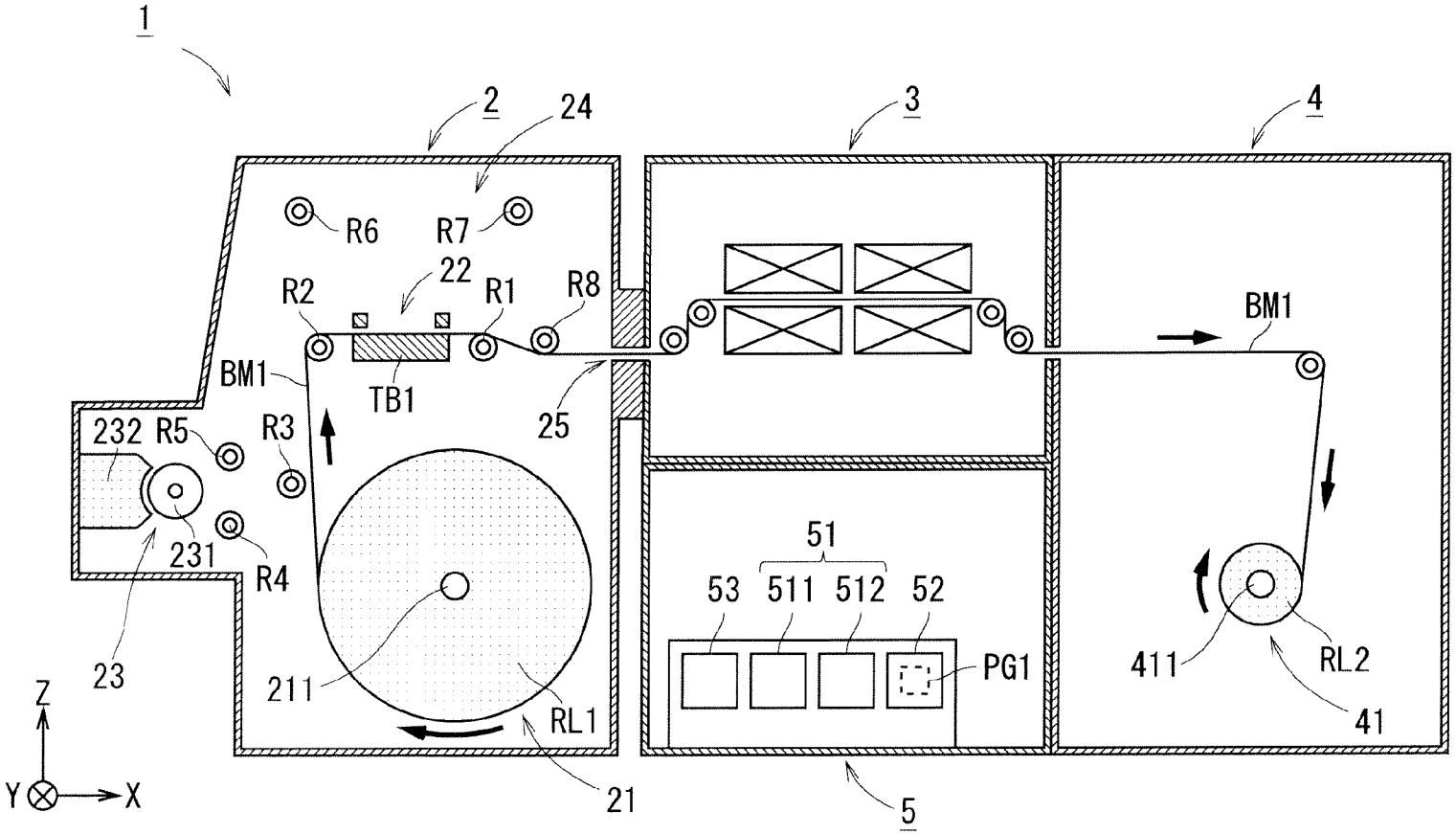
FIG. 12 schematically illustrates an example of a switched conveyance path of a base material.

Then, as illustrated in FIG. 11, the driving parts Ac1 and Ac2 respectively move the movable parts MP1 and MP2 from the catch position Pc1 to the spaced position Pd1. Accordingly, the base material BM1 becomes conveyable on the table part TB1. In other words, the base material BM1 (specifically, the coupled base materials BM11 and BM12) is taken up by the take-up part 41, and accordingly another base material BM1 that is drawn from the outer circumference of the new exchanged roll RL1 is conveyed.

(4) Switching of Conveyance Path of Base Material

FIG. 1 illustrates an example of the conveyance path of the base material BM1 that extends from the unwinder 21 to the base material supply part 25 through the first supporter 22, the surface modifying part 23, and the second supporter 24 in order, but the image recording apparatus 1 according to the present preferred embodiment is capable of switching the conveyance path to another one. For example, if the base material BM1 has excellent ink wettability, the conveyance path may be switched to another one that does not pass through the surface modifying part 23.

FIG. 12 schematically illustrates an example of a switched conveyance path of the base material BM1 in the image recording apparatus 1. FIG. 12 illustrates a short conveyance path along which the base material BM1 unwound from the unwinder 21 is conveyed through the first supporter 22 to the base material supply part 25 without passing through the surface modifying part 23 and the second supporter 24. Specifically, the base material BM1 unwound from the unwinder 21 is first conveyed to the first supporter 22. In the first supporter 22, the base material BM1 is supported by the roller R2, the table part TB1, and the roller R1 in order. The base material BM1 is then conveyed from the first supporter 22 through the roller R8 to the base material supply part 25.

With such a conveyance path, when the roll RL1 is exchanged, the front end of the base material BM1 can be drawn from the new roll RL1 to the first supporter 22 along the short conveyance path without passing through the surface modifying part 23. It is thus possible to, for example, readily couple the base materials BM1 to each other on the table part TB1 without the need of complicated operations when the roll RL1 is exchanged. That is, it is easy to exchange the roll RL1. In addition, the short conveyance path of the base material BM1 reduces an area of the base material BM1 that is not to be used to record an image when the roll RL1 is exchanged. In other words, the rate of waste (waste paper) in the base material BM1 is reduced.

(5) Summary of Preferred Embodiment

As described above, in the image recording apparatus 1 according to the present preferred embodiment, the unwinder 21 is disposed on at least one of the virtual line segment that connects the surface modifying part 23 and the base material supply part 25, the virtual line segment that connects the surface modifying part 23 and the recorder 3, and the normals to these line segment. It is thus possible to increase the distance between the surface modifying part 23 and the recorder 3 without increasing the sizes of the image recording apparatus 1 and the base material supply unit 2. This reduces adverse effects of noise caused by the surface modifying part 23 performing pre-processing for modifying the surface of the base material BM1.

(6) Variations

Note that the present invention is not limited to the above-described preferred embodiment, and various modifications and improvements are for example possible without departing from the scope of claims of the present invention.

For example, while the above-described preferred embodiment takes the example of the image recording apparatus 1 in which the base material supply unit 2, the recorder 3, and the base material collecting unit 4 are configured as a single entity, the present invention is not limited thereto. An embodiment may, for example, be employed in which the base material supply unit 2 serving as a base material supply apparatus is distributed as a separate entity from the recorder 3. In this case, the base material supply unit 2 may be coupled to a preset position of the recorder 3. Such a configuration can also achieve effects similar to those of the above-described preferred embodiment. Alternatively, another embodiment may be employed in which the base material supply unit 2 serving as a base material supply apparatus, the recorder 3 serving as a recording apparatus, and the base material collecting unit 4 serving as a base material collecting apparatus are distributed separately. In this case, the image recording apparatus 1 may be assembled by, for example, coupling the base material supply unit 2 and the base material collecting unit 4 to the recorder 3.

While the above-described preferred embodiment takes the example of the case where the first supporter 22 includes the two rollers R1 and R2, the present invention is not limited thereto. For example, the first supporter 22 may not include one of the two rollers R1 and R2. In other words, it is sufficient for the first supporter 22 to include at least one of the rollers R1 and R2, which are rotatably provided to support the base material BM1, in order to make it possible to readily convey and support the base material BM1. Note that in the case where the first supporter 22 is provided with only one of the two rollers R1 and R2, the base material BM1 will be less susceptible to damage if corner portions of the table part TB1 that are in contact with the base material BM1 are finished in a curved shape, for example.

While the above-described preferred embodiment takes the example of the case where the first supporter 22 includes the two rollers R1 and R2 and the table part TB1, the present invention is not limited thereto. For example, a configuration may be employed in which the first supporter 22 includes only the table part TB1 without including the two rollers R1 and R2. In this case, the base material BM1 will be less susceptible to damage if the corner portions of the table part TB1 that are in contact with the base material BM1 are finished in a curved shape. It is, however, noted that the first supporter 22 that includes at least one of the rollers R1 and R2, which are rotatably provided to support the base material BM1 makes it easier to smoothly convey and support the base material BM1.

While the above-described preferred embodiment takes the example of the case where the first supporter 22 includes the table part TB1, the present invention is not limited thereto. For example, a configuration may be employed in which the first supporter 22 does not include the table part TB1. This configuration does not require the provision of the movable parts MP1 and MP2 and the driving parts Ac1 and Ac2. It is, however, noted that the first supporter 22 that includes the table part TB1 for supporting the base material BM1 makes it easier to perform various types of processing such as cutting on the base material BM1 before being subjected to surface modification by the surface modifying part 23, on the table part TB1.

While the above-described preferred embodiment takes the example of the case where the table part TB1 includes the knife-edge bearing area Ab1 the present invention is not limited thereto. For example, the table part TB1 does not necessarily have to include the knife-edge bearing area Ab1. It is, however, noted that the table part TB1 that includes the knife-edge bearing area Ab1 makes it easier to precisely cut the base material BM1 on the table part TB1.

While the above-described preferred embodiment takes the example of the case where the first supporter 22 includes the movable parts MP1 and MP2, that catch hold of the base material BM1 in between themselves and the table part TB1, and the driving parts Ac1 and Ac2, the present invention is not limited thereto. For example, the first supporter 22 does not necessarily have to include the movable parts MP1 and MP2 and the driving parts Ac1 and Ac2. In this case, the base material BM1 may be cut by, for example, placing a rubber sheet with a scale between the table part TB1 and the base material BM1 and cutting the base material BM1 along the scale. It is, however, noted that the first supporter 22 that includes the movable parts MP1 and MP2 and the driving parts Ac1 and Ac2 allows various types of processing such as cutting to be performed on the base material BM1 before being subjected to surface modification in a state in which the base material BM1 is fixed to the table part TB1. It is thus possible to readily and precisely perform various types of processing on the base material BM1.

While the above-described preferred embodiment takes the example of the case where the first supporter 22 includes the two movable parts MP1 and MP2 and the driving parts Ac1 and Ac2 for moving the movable parts MP1 and MP2, the present invention is not limited thereto. For example, the first supporter 22 may include at least one of the two movable parts MP1 and MP2, and a driving part for moving the movable part. It is, however, noted that the base material BM1 can more precisely be cut on the table part TB1 if the first supporter 22 includes the movable parts MP1 and MP2 that respectively have the first and second abutment parts AP1 and AP2 and catch hold of the base material BM1 in between themselves and the first and second areas Ar1 and Ar2, which are located on both sides of the knife-edge bearing area Ab1.

While the above-described preferred embodiment takes the example of the case where the driving parts Ac1 and Ac2 independently move the movable parts MP1 and MP2 between the catch position Pc1 and the spaced position Pd1, the present invention is not limited thereto. For example, the movable parts MP1 and MP2 may be moved in synchronization with each other, not independently, between the catch position Pc1 and the spaced position Pd1. It is, however, noted that employing the configuration in which the movable parts MP1 and MP2 independently move between the catch position Pc1 and the spaced position Pd1 makes it possible to precisely couple the base materials BM1 to each other on the table part TB1 when the roll RL1 is exchanged, for example.

While the above-described preferred embodiment takes the example of the case where the first supporter 22 and the second supporter 24 are provided upward of the roll RL1, the present invention is not limited thereto. For example, a configuration may be employed in which the first supporter 22 and the second supporter 24 are provided downward of the roll RL1. It is, however, noted that when the weight of the roll RL1 is high, providing the first supporter 22 and the second supporter 24 upward of the roll RL1 makes it easier to mount the roll RL1 on the unwinder 21. In addition, disposing the second supporter 24 at a higher level makes it easier to dispose the recorder 3 at a higher level and to maintain and manage the recorder 3 from below.

It goes without saying that all or some of the constituent elements according to the above-described preferred embodiment and variations may be combined appropriately as long as there are no mutual inconsistencies.

While the invention has been shown and described in detail, the foregoing description is in all aspects illustrative and not restrictive. It is therefore understood that numerous modifications and variations can be devised without departing from the scope of the invention.

What is claimed is:

1. An image recording apparatus comprising:

an unwinder that unwinds a sheet-like base material from a roll around which said base material is cylindrically wound;

a recorder that records an image onto a surface of said base material;

a take-up part that takes up said base material on which an image has been recorded by said recorder;

a first supporter that supports said base material that is being conveyed in a first direction away from said recorder after having been unwound from said unwinder;

a surface modifying part that modifies the surface of said base material by energizing the surface of said base material that has passed through said first supporter; and a second supporter that supports said base material that is being conveyed in a second direction toward said recorder after having passed through said surface modifying part, wherein said second supporter is more distant from said unwinder than said first supporter is, and said unwinder is disposed on at least one of a virtual line segment that connects said surface modifying part and said recorder and a normal to the line segment.

2. The image recording apparatus according to claim 1, wherein said first supporter includes at least one roller that is rotatably provided to support said base material.

3. The image recording apparatus according to claim 1, wherein said first supporter includes a table part that supports said base material.

4. The image recording apparatus according to claim 3, wherein said table part has an opening in a base material supporting surface that supports said base material, and has a groove-like knife-edge bearing area that extends in a direction that intersects said first direction.

5. The image recording apparatus according to claim 3, wherein said first supporter further includes:

a movable part provided facing a base material supporting surface of said table part that supports said base material; and a driving part that moves said movable part between a catch position and a spaced position, said catch position being a position at which said movable part catches hold of said base material supported by said table part in between said movable part and said table part, and said spaced position being a position at which said movable part is spaced from said base material supported by said table part.

6. The image recording apparatus according to claim 4, wherein said first supporter further includes:

a movable part provided facing said base material supporting surface; and a driving part that moves said movable part between a catch position and a spaced position, said catch position being a position at which said movable part catches hold of said base material supported by said table part in between said movable part and said table part, and said spaced position being a position at which said movable part is spaced from said base material supported by said table part.

7. The image recording apparatus according to claim 6, wherein said movable part includes:

a first abutment part that catches hold of said base material between said first abutment part and a first area of said base material supporting surface, said first area being located on a side opposite said first direction from said knife-edge bearing area; and a second abutment part that catches hold of said base material between said second abutment part and a second area of said base material supporting surface, said second area being located on a side toward said first direction from said knife-edge bearing area.

8. The image recording apparatus according to claim 7, wherein said driving part individually moves said first abutment part and said second abutment part between said catch position and said spaced position.

9. The image recording apparatus according to claim 1, wherein said surface modifying part includes a corona discharge part that energizes a surface of said base material by a corona discharge to modify the surface of said base material.

10. The image recording apparatus according to claim 1, wherein said surface modifying part includes a plasma application part that energizes a surface of said base material by application of plasma to modify the surface of said base material.

11. A base material supply apparatus for supplying a sheet-like base material to a recorder that records an image onto a surface of said base material, comprising:

an unwinder that unwinds said base material from a roll around which said base material is cylindrically wound;

a base material supply part that supplies said base material to said recorder;

a first supporter that supports said base material that is being conveyed in a first direction away from said base material supply part after having been unwound from said unwinder;

a surface modifying part that modifies a surface of said base material by energizing the surface of said base material that has passed through said first supporter; and a second supporter that supports said base material that is being conveyed in a second direction toward said base material supply part after having passed through said surface modifying part, wherein said second supporter is more distant from said unwinder than said first supporter is, and said unwinder is disposed on at least one of a virtual line segment that connects said surface modifying part and said base material supply part and a normal to the line segment.

* * * * *